United States Patent [19]

Sauer

[11] 4,075,586

[45] Feb. 21, 1978

[54] ELECTROMAGNETIC RELAY

[75] Inventor: Hans Sauer, Deisenhofen, Germany

[73] Assignees: Matsushita Electric Works, Ltd., Osaka, Japan; Hans Sauer, Deisenhofen, Germany; a part interest to each

[21] Appl. No.: 661,025

[22] Filed: Feb. 24, 1976

[30] Foreign Application Priority Data

Feb. 24, 1975 Germany ..... 2507914

[51] Int. Cl.[2] ..... H01H 51/27

[52] U.S. Cl. ..... 335/79; 335/151; 335/179

[58] Field of Search ..... 335/78, 79, 80, 132, 335/151, 179, 202

[56] References Cited

U.S. PATENT DOCUMENTS

| | | | |
|---|---|---|---|
| 3,522,564 | 8/1970 | Mori et al. | 335/78 X |
| 3,587,011 | 6/1971 | Kurz | 335/151 |
| 3,747,035 | 7/1973 | Morimoto et al. | 335/202 X |

*Primary Examiner*—A. D. Pellinen

*Attorney, Agent, or Firm*—Wigman & Cohen

[57] ABSTRACT

An electromagnetic relay consists of a structural member that defines a longitudinal plane and forms an interior protective space. Part of the member is a bobbin with a coil mounted on it situated around the space. The space extends the entire length of the member which is open at both ends. Fixed contacts extend into the protective space and a contact actuator is mounted in the space so as to extend along the bobbin while having a free end in proximity to the fixed contacts for cooperation therewith. Terminals are connected to the coil, to the actuator and to the fixed contacts. These terminals are embedded in and extending outwardly from the structural member on opposite sides thereof in the longitudinal plane. An outer protective casing is formed of two casing members sealed together generally in this plane, the casing and the structural member together forming a seal around each terminal. The open ends of the structural member are sealed. At one such end this seal is achieved by mutually cooperating surfaces of the structural member and the casing members.

15 Claims, 15 Drawing Figures

ELECTROMAGNETIC RELAY

The present invention relates to an electromagnetic relay of the so-called "dual in line" type. A relay of this type is described, for example, in the U.S. Pat. No. 3,575,678 issued Apr. 20, 1971 to W. F. Barton.

For the purpose of protecting the contacts of this type of relay, the terminals that extend from the relay are embedded in insulating material. In order to ensure maximum reliability of the contacts and the maintenance of accurately predetermined contact resistance values, the contact chamber, prior to embedding the relay proper, is cleaned in an ultrasonic cleaning bath, degassed in a vacuum in the presence of heat and finally closed by means of a specially designed housing can. As it is relatively difficult to obtain access to the contact chamber, it is necessary to exercise special care in this cleaning of the contact chamber. The necessity of closing the contact chamber before the embedding operation tends to increase the cost of manufacture. Another economic disadvantage is to be seen in the necessity of using electroplated contacts, in view of the fact that, due to the manufacturing methods employed, the surfaces to be gold- or rhodium-plated have to be made much larger than would be necessary for satisfactory operation of the contacts.

Another disadvantage of the known type relay is to be seen in the fact that a relatively large distance between the ends of the pole shoes and the adjacent end of the coil chamber tends to promote the occurrence of stray losses, such losses causing the efficiency of the relay to be reduced. While it is known to increase the efficiency of the magnet system of such a relay by using larger pole surfaces, the use of such larger pole surfaces tends either to introduce adjustment difficulties or to shorten the creep paths at those ends of the current-carrying pole shoes that are adjacent the respective terminals.

It is a major object of the present invention to provide a relay of the dual in line type in which the contact system is particularly easily accessible for cleaning purposes, the contacts of which are capable of carrying larger currents than those of known relays, and which is capable of being manufactured on a mass-production scale while being perfectly sealed from its environment in an economical manner.

According to the invention, this object is achieved by the provision of an electromagnetic relay comprising (a) a structural member defining a longitudinal plane and forming an interior protective space and a bobbin around said space, the space extending the entire length of the member which is open at both ends, (b) a coil mounted on said bobbin, (c) fixed contact means extending into the protective space, (d) a contact actuator mounted in said space to extend along said bobbin and having a free end disposed in proximity to said fixed contact means for cooperation therewith, (e) terminals connected to the coil, the actuator and the fixed contact means, said terminals being embedded in and extending outwardly from said member on opposite sides thereof in said plane, (f) an outer protective casing formed of two casing members sealed together generally in said plane, said protective casing and said structural member together forming a seal around each said terminal, and (g) means sealing said open ends of said member, at least at one of the open ends, said sealing means including mutually cooperating surfaces of said structural member and said casing members.

In order that the invention may be more fully understood, embodiments of it will be described in the following text by way of example, with reference to the accompanying drawings, in which.

Figure 1:
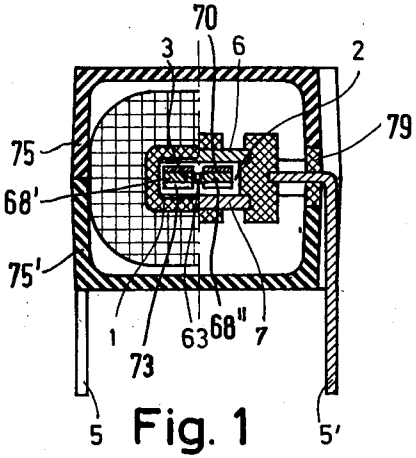
FIGS. 1 to 3 show a relay according to a first embodiment, FIG. 1 being a section on I—I' in FIG. 3, FIG. 2 being a front elevation, the top half of FIG. 3 being a section at III in FIG. 2 and the lower half of FIG. 3 being a section on III'— III'' in FIG. 2.
Figure 2:
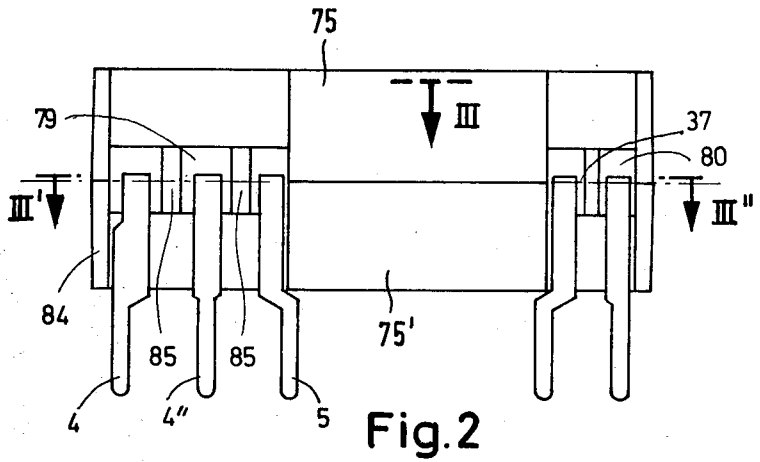

The relay shown in FIGS. 1 to 4 comprises an actuator 3 arranged in a protective space in the form of a tube 2 formed in a coil bobbin 1 constituting a part of a main structural member 1'. Also mounted in this member are contact terminals 4, 4' and 4'' and coil terminals 5 and 5'. In addition, there are provided two pole shoes 6 and 7, the inner end portions of which are located on opposite sides of the free end 9 of the actuator 3 in a contact chamber 8 formed within the structural member 1'. The outer end portions 10 and 11 of the pole shoes 6, 7 embrace a permanent magnet 13. These pole shoes may either be embedded in the structural member 1' for positive location or inserted into matching recesses in the member 1'. Prior to insertion of the magnet 13, the space defined by the tube 2, the contact chamber 8 and the magnet chamber 12 extends the entire length of the member 1' and this space is open at both its end faces 14 and 15. This arrangement greatly facilitates cleaning of the contact chamber 8, the actuator 3 and the relay contacts formed by the inner end portions 18 and 19 of the pole shoes 6, 7, which portions are coated with a contact material 20. In addition, this arrangement permits easy degassing of the contact chamber 8 and the tube 2, this feature being important for achieving maximum dependability of contact operation.

Figure 3:
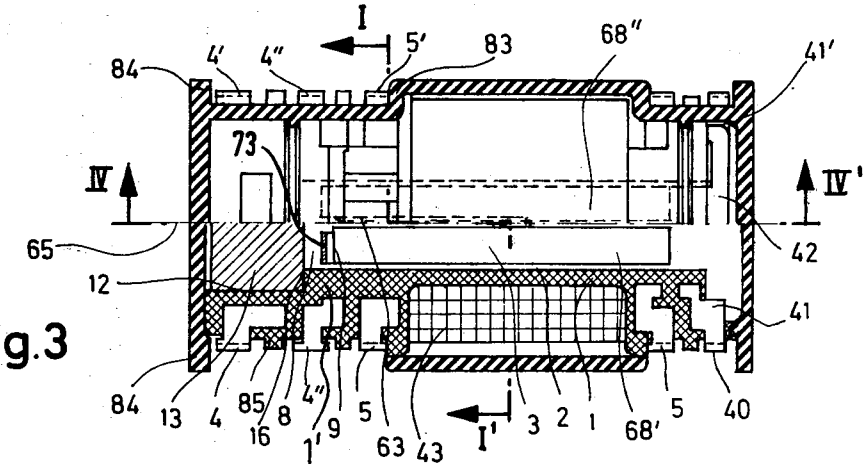
Figure 4:
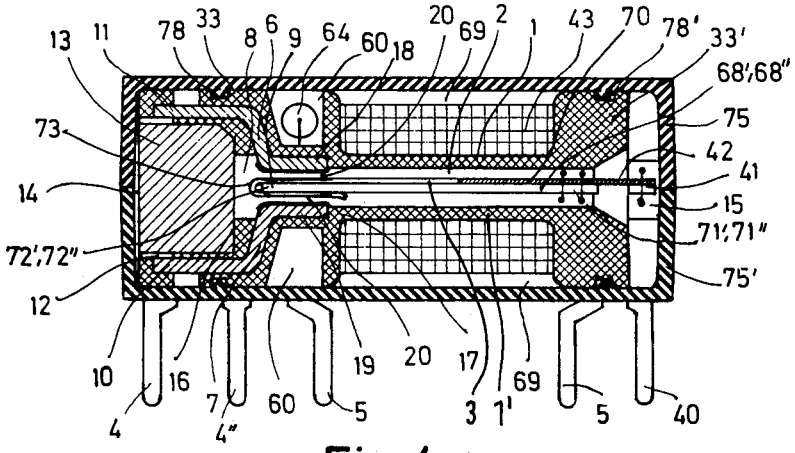
FIG. 4 is a section on IV—IV' in FIG. 3.

The terminals 4 and 5 etc. which are associated with the energizing coil 43, and with the contacts of the relay (with optionally provided additional circuit elements 64) extend from the structural member 1' on two oppositely directed sides thereof in a longitudinal plane 37 (FIG. 2) containing the longitudinal axis 65 of the bobbin 1 (FIG. 3). The additional circuit elements 64 can, for example, be arranged in chambers 60 which, as seen in FIG. 4, are formed in a flange 33 of the structural member 1'. Externally, the relay is protected by a casing comprising two members or halves 75 and 75' of identical shape. The two casing halves can be interconnected, for example, by means of an ultasonic welding process in the plane 37. This method of providing a tight seal around the interior of the relay has been found to be superior to the use of adhesives or potting compounds from the aspect of economical manufacture. In addition, the employment of this method will prevent any contamination of the walls of the contact chamber 8 and the atmosphere contained therein. Thus, the manner in which the relay is sealed tends to enhance the dependability of the contacts.

In order to combine a high degree of elasticity and a relatively large cross section of ferrous material, the actuator 3 of this embodiment is formed by a copper-bearing leaf spring 70, to opposite sides of which two elongated ferromagnetic plates 68' and 68" are attached. As seen in FIGS. 3 and 4, the right-hand end 42 of the plate spring 70 is secured to exposed portions 41 and 41' of contact carriers 40 extending from the associated end face of the right-hand bobbin flange 33'. This construction of the actuator 3 ensures the attainment of relatively large contact forces, the result being that it is possible to employ solid contact material inserts in the inner ends 18 and 19 of the pole shoes 6 and 7 as well as on the cooperating actuator 3, such inserts being characterized by a high current-carrying capacity. In addition, the availability of larger contact forces permits the provision of wider air gaps between the contacts, this in turn resulting in an increase in the dielectric strength of the contact gaps. As will be seen in FIGS. 1 and 3, the actuator 3 is provided at its free end 9 with a longitudinally extending slot 63 serving to define two separate contacts. One each of the aforementioned ferromagnetic plates 68', 68" is arranged on either side of the slot 63, the length of such plates corresponding substantially to the length of the leaf spring 70, and the right-hand ends 71', 71" of such plates being connected to the leaf spring 70 near its clamping point, such connection being effected, for example, by spot welding. The free end 73 of the leaf spring 70 is folded back onto itself to form a U-shaped portion enclosing the left-hand ends 72', 72" of the ferromagnetic plates 68', 68" so as to retain them securely in position.

In FIGS. 1 to 4 it will also be seen that there is provided between the contact chamber 8 and the magnet chamber 12 a supporting surface 16 cooperating with a substantially parallelepiped permanent magnet 13. Portions of the pole shoes 6, 7 extend from opposed walls of the contact chamber 8 towards points in the vicinity of the end face 17 of the space provided for the reception of the energizing coil 43. Since the angulated inner ends 18, 19 of the pole shoes 6, 7 extend into the area at the end of the coil 43 in which only a small amount of stray flux is present, and since the pole shoes have relatively large pole faces extending parallel to the actuator 3, stray flux losses are kept to a minimum, the result being that maximum efficiency is achieved and the force of the permanent magnet 13 is utilized to the greatest possible extent for the purpose of generating contact forces. An additional advantage of this arrangement resides in the fact that despite the large size of the pole faces it will not be necessary to adjust or calibrate the pole shoes 6, 7 in cases in which the pole shoes are positively located by being embedded in the structural member 1'.

Figure 5:
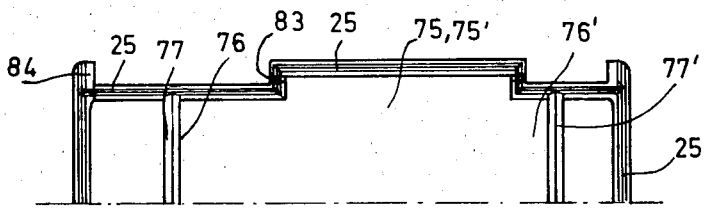
FIG. 5 shows an inside view of a casing half of the relay of FIGS. 1–4.
Figure 6:
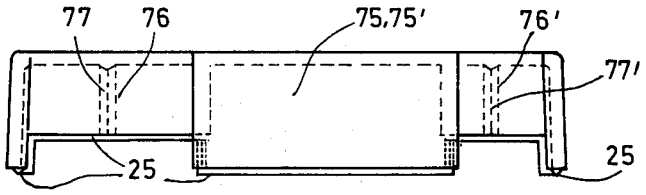
FIG. 6 is an outside view of the casing half of FIG. 5 but showing a modification.
Figure 8:
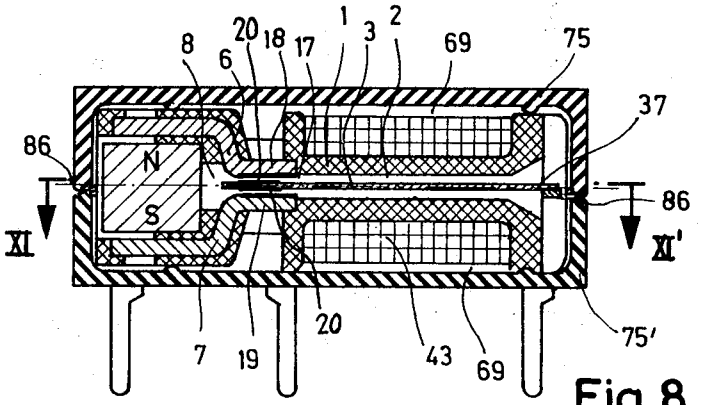
FIGS. 7 to 12 show further views of an embodiment incorporating the modification of FIG. 6, FIG. 7 being a section on VII—VII' in FIG. 11, FIG. 8 being a section on VIII—VIII' in FIG. 11, FIG. 9 being a fragment of a front elevation, FIG. 10 being a section on X—X' in FIG. 11, FIG. 11 being a section on XI—XI' in FIG. 8, and FIG. 12 being a section on XII—XII' in FIG. 11.
Figure 11:
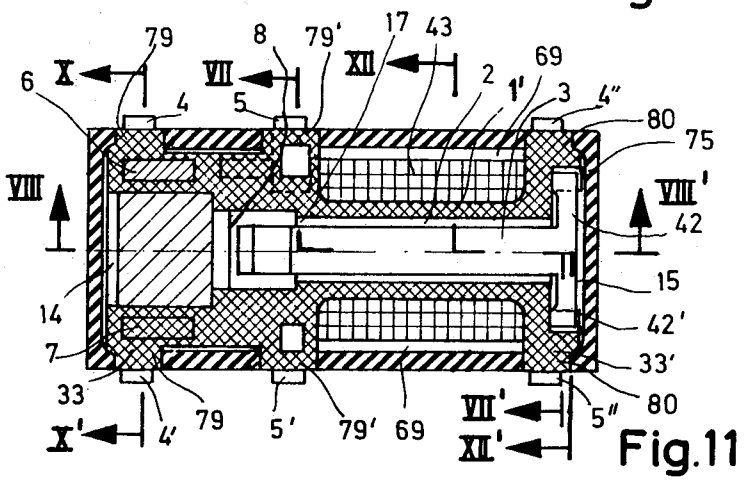

The two-part casing enclosing the relay shown in FIGS. 1 to 4 is structured in such a manner as to separate the contact chamber 8 and the coil chamber 69 from one another. While the relay as a whole is isolated from its environment, this inner separation will also preclude any detrimental effect on the system of contacts by substances that might be evaporated from the coil 43 upon the heating thereof. FIGS. 5 and 6 each show one half 75 or 75', respectively, of the relay casing. For the purpose of separating the contact chamber 8 from the coil chamber 69, each half has the general shape of a trough and is provided in those areas of its internal surfaces 76, 76' in contact with the flanges 33, 33' with ridge-like projections 77, 77'. In addition, the flanges 33, 33' are formed with groove-like recesses 78, 78' disposed opposite the ridge-like projections 77, 77'. Using an ultrasonic welding process, it is possible in a single operation to enclose the relay in its casing and simultaneously hermetically isolate the contact chamber 8 from the coil chamber 69. In order to promote a tight connection between the casing halves, those portions of the casing halves 75, 75' which are to be arranged in contact with one another, with the structural member 1' or with sleeve-like formations 79, 80 of the member are provided with ridge-like projections or rounded beads 25. The formations 79, 80 surround the terminals 4, 5 etc. extending from the member 1' so that it is not necessary to directly seal such terminals with associated portions of the casing halves 75, 75'. In addition, the two housing halves 75, 75' are provided on opposite sides of the pairs of contact and coil terminals 4, 5 etc. enclosed by said sleeve-like formations 79, 80 with wall portions 83 or projections 84 extending in the same direction as said terminals. This feature provides a certain amount of protection against inadvertent contact with or bridging of the contact and coil terminals 4, 5 etc. and at the same time permits the capacity of the coil chamber 69 of the relay to be increased without exceeding to any substantial degree of the rectangular plan form of the relay which, in the case of the dual in line type, is defined by the terminals extending from opposite sides of the relay. In order further to increase the dielectric strength between adjacent contact and coil terminals 4, 5 etc, rib-like projections 85 are provided between such terminals and the sleeve-like formations 79, 80.

FIGS. 7 to 12 show another embodiment of the relay which also comprises a member 1' having embedded therein a plurality of contact and coil terminals 4, 4', 4", 5, 5', 5", a portion of the member 1' forming a bobbin defining a protective tube 2 surrounding the actuator 3. In this embodiment the actuator 3 is made of a ferromagnetic material, the root portions 42, 42' of the actuator being attached to exposed end portions 41, 41' of a contact carrier provided with contact terminals 4", 5", the free end 9 of the actuator 3 being coated with a contact material 20. Coatings of contact material 20 are also provided on the pole shoes 6, 7 which are arranged in the contact chamber 8 in such a manner as to be opposite the free end 9 of the actuator 3, whereby the pole shoes constitute fixed contacts. In order to provide for large-size pole faces and for large contact forces, the pole shoes 6, 7, similarly to the embodiment of FIGS. 1 to 4, have bent inner end portions 18, 19 which extend into an area adjacent the end face 17 of the chamber 69 for the energizing coil 43 where stray flux is at a minimum. As will be seen in FIGS. 8 and 10, the pole shoes 6, 7 are formed as blanked and bent members that extend towards and over the oppositely facing poles of the permanent magnet 13 and are conductively spot-welded to the contact terminals 4, 4' before being embedded in the flange 33 of the member 1'. In the present case, the contact terminals 4, 4', before being embedded (for example by means of an injection or pressing or pressure injection process), form portions of a sheet metal member and are connected to the terminals 5, 5', 5'', 4'' by webs. Upon completion of the member 1', the terminals 4, 4',4'', 5, 5', 5'' are separated from one another by a cutting operation and then bent downwardly.

Figure 7:
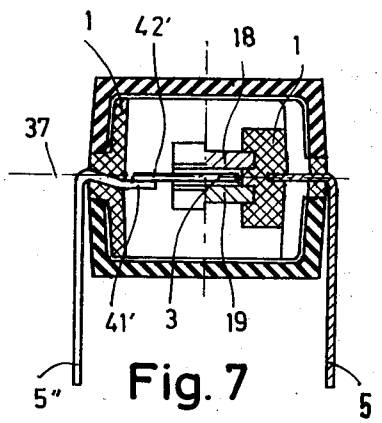
Figure 10:
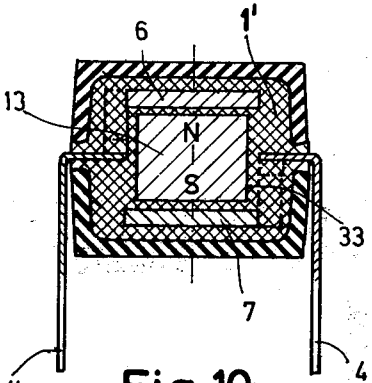
Figure 13:
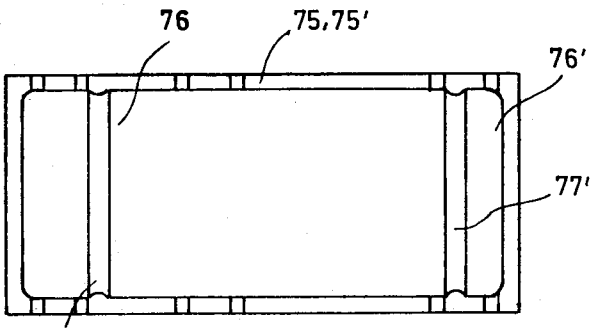
FIG. 13 shows an inside plan view of a casing member of the embodiment of FIGS. 7 to 12.

In cases in which the relay is intended to be operated as a bistable switching device, the exposed portion 41' of the terminal 5'' embedded in the member 1', as shown in FIG. 7, is calibrated during the embedding operation by being bent with the aid of the manufacturing tool. The bending operation is performed in such a manner that the actuator 3, the root end 42' of which is secured, as by spot-welding, to the exposed portion 41', is positioned in the central plane 37 of the relay. In the case of the embodiment of FIGS. 1 to 4 and of FIGS. 7 to 12, the actuator 3 is shown in such a position. The said central plane 37 is the plane in which the contact terminals 4, 5 etc. are led out of the relay. This method of positioning the actuator 3 makes it possible in an economical manner to provide for uniform conditions for either position of the change-over contact. In cases, however, in which the relay is intended to be used as a monostable device having a normally open or a normally closed contact, the exposed portion 41' of the terminal 5'' is left in its position in the plane 37. In this case, the root end 42' of the actuator 3 is spot-welded to the opposite side of the exposed portion 41', the result being that the free end 9 of the actuator 3 will bear against the angulated inner end 19 of the pole shoe 7 with sufficient contact force, without requiring any special adjustment. It is thus possible in a simple manner to provide a normally closed contact.

Before the permanent magnet 13 is inserted, the member 1' is open at its two end faces 14, 15, the result being that the contact system is easily accessible for cleaning.

Figure 14:
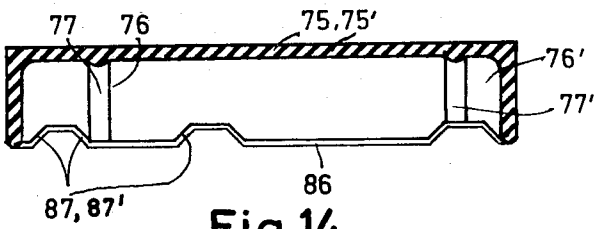
FIG. 14 shows a longitudinal cross-section of this casing.
Figure 12:
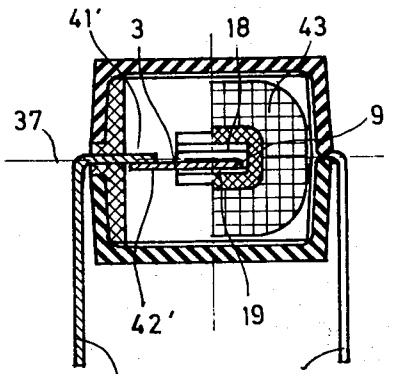
Figure 9:
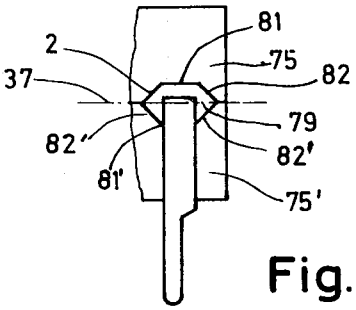

In order to provide additional protection for the contact system, the relay is hermetically enclosed in a two-part casing. In the present embodiment, the contact chamber 8 and the coil chamber 69 are again separated from one another. The two trough-like casing halves 75, 75' are of identical shape, and on their interior surfaces and more particularly within the areas 76, 76' within which they are in contact with the flanges 33, 33' they are provided with bead- or ridge-like projections 77, 77'. In addition, the casing halves 75, 75' are formed with rounded edges 86 in those areas in which they are brought into contact with one another or the member 1' or the sleeve-like formations 79, 79', 80 with which the member 1' is formed where the terminals 4, 5 etc. extend therefrom. Upon the casing halves 75, 75' being welded together by means of ultrasonic energy, the bead- or ridge-like projections 77, 77' and the rounded edges 86 are fused together, the result being that the contact system of the relay is isolated from both the environment and the coil chamber 69 in a single operation and without the employment of any additional sealing means. In order to seal the terminals 4, 5 etc. in a satisfactory manner and without any difficulty, they are embedded in sleeve-like formations 79, 80 of the member 1', as shown in FIG. 9, such formations being provided on opposite sides thereof with plane supporting surfaces 81, 81' to be engaged by the two casing halves 75, 75'. The said sleeve-like formations 79, 80 are provided with surfaces 82, 82' which are inclined towards the lead-out plane of the coil and contact terminals 4, 5 etc. Such inclined surfaces 82, 82' constitute supporting surfaces for corresponding inclined surfaces 87, 87' with which, according to FIG. 14, the two casing halves 75, 75' are provided and which extend, for example, at the angle of about 45° to the said lead-out plane. The employment of the sleeve-like formations 79, 79', 80 with which the member 1' may be provided without any additional expense, for example during the molding operation, makes it possible in a simple manner to avoid the technically relatively complicated direct sealing of the terminals 4, 5 etc. during enclosing of the relay in its casing.

Figure 15:
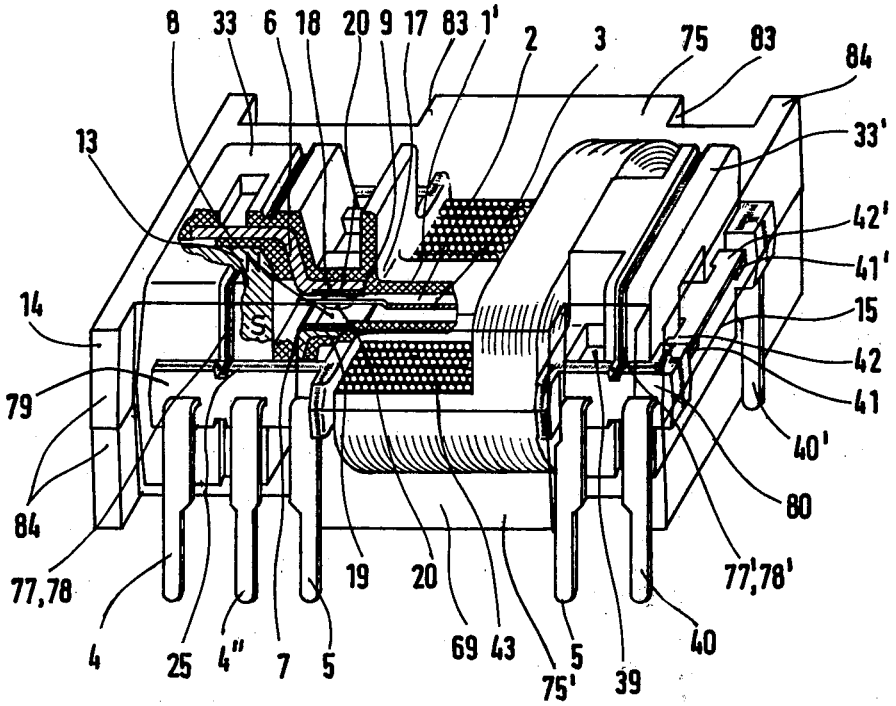
FIG. 15 is an isometric, partly broken away view of a relay similar to that of FIGS. 1 to 4.

FIG. 15 shows an electromagnetic relay having a ferromagnetic actuator 3 arranged within a protective tube 2 forming part of a bobbin of a member 1'. The actuator has a free end 9 coated with a contact material 20 and disposed between inner end portions 18, 19 of pole shoes 6, 7 which extend from the corresponding walls of the contact chamber 8. These inner end portions 18, 19 are also coated with a contact material 20. The inserts consisting of the contact material 20 also constitute magnetic separating sheet metal members. The presence of large overlapping areas between the free end 9 of the actuator 3 and the internally offset end portions 18, 19 of the pole shoes 6, 7 and the fact that such end portions are arranged in an area in the vicinity of the end face 17 of the chamber containing the coil 43, in which area the stray flux is at a minimum, ensure the attainment of large contact forces at low energizing levels of the coil 43.

For the purpose of economically manufacturing the relay, the contact and coil terminals 4, 4', 4'', 5, 5', 5'' are positively located in the member 1' by being firmly embedded therein, the portions of such terminals extending outwardly from the member 1' being surrounded by sleeve-like formations 79, 80 formed of the same material as the member 1'. In addition, terminals 5, 40, 40' each include an exposed portion 39 or 41 or 41', such exposed portions being conductively connected to a terminal of the coil 43 or one of the root portions 42, 42' of the actuator 3 by spot welding. Prior to insertion of the permanent magnet 13 into the contact chamber 8, the member 1' is open at both end faces 14, 15. Therefore, it is relatively easy to effectively clean the contact system by means of ultrasonic energy and to degas the contact system. In order to ensure a maximum service life of the relay, the contacts are hermetically isolated from the environment of the relay as well as from the coil chamber 69 by two casing members 75, 75'. To achieve this effect, the two casing halves 75, 75' are provided with ridge-like projections 77, 77', 25 in the vicinity of the flanges 33, 33' and in those regions in which said halves are brought into contact with one another or said sleeve-like formations 79, 80, the two casing halves are welded together with the aid of an ultrasonic welding process. This welding operation causes the projections 77, 77', 25 to be fused together at their contacting surfaces, a gas-tight seal being formed during this operation. In order to provide for a particularly tight seal between the contact chamber 8 and the coil chamber 69, the flanges 33, 33' are additionally provided with groove-like recesses 78, 78' matching the ridge-like projections 77, 77'. Furthermore, the casing halves 75, 75' are provided, on both sides of the sleeve-like formations 79, 80, with wall portions 83 and projections 84 extending in the directions in which the terminals 4, 5 etc. extend from the member 1', such wall portions and projections serving to protect the terminals 4, 5 etc. against undesirable contact and to increase the capacity of the coil chamber 69 without resulting in any substantial increase in the dimensions of the relay in a horizontal plane.

This relay, which is of the dual-in-line type, is characterized by a dependable contact system having a high current-carrying capacity. A magnetic circuit constituted by the permanent magnet 13 and the pole shoes 6, 7 makes it possible to use the relay as a monostable or a bistable switching device. Due to its simple construction, the relay is easily assembled, an important feature thereof residing in the fact that it is capable of being hermetically sealed by means of the two casing members 75, 75' only.

I claim:

1. An electromagnetic relay comprising:

a. a one-piece structural member defining a longitudinal plane and forming an interior protective space and a bobbin around said space, the space extending the entire length of the member which is open at both ends;

b. a coil mounted on said bobbin;

c. fixed contact means extending into the protective space;

d. a contact actuator mounted in said space to extend along said bobbin and having a free end disposed in proximity to said fixed contact means for cooperation therewith;

e. terminals connected to the coil, the actuator and the fixed contact means, said terminals being embedded in and extending outwardly from said structural member on opposite sides thereof in the longitudinal plane defined by said structural member;

f. an outer protective casing formed of two casing members sealed together generally in said longitudinal plane, said protective casing and said structural member together forming a seal around each said terminal; and g. means sealing said open ends of said structural member, the sealing means of at least one of said open ends comprising first surfaces formed on said structural member and second surfaces formed on said casing members, said first and second surfaces mutually cooperating with each other.

2. An electromagnetic relay according to claim 1, wherein said actuator comprises a copper-bearing leaf spring to which is attached at least one elongated ferromagnetic plate, one end of said leaf spring being secured to portions of at least one said terminal extending from an end face of said bobbin.

3. An electromagnetic relay according to claim 2, wherein the ferromagnetic plate is substantially of the same length as the leaf spring, one end of said plate being secured to said leaf spring in the vicinity of the location at which said leaf spring is clamped in position, the free end of said leaf spring being rearwardly bent to U-shape to surround the other end of said ferromagnetic plate.

4. An electromagnetic relay according to claim 2, wherein said leaf spring has a free end formed with a longitudinally extending slot, one said ferromagnetic plate being arranged on each respective side of said slot.

5. An electromagnetic relay according to claim 2, wherein said leaf spring is secured by welding to said ferromagnetic plate.

6. An electromagnetic relay according to claim 1, wherein said protective space defines a contact chamber, a magnet chamber and a supporting surface for a substantially parallelepiped permanent magnet, pole shoes extending from opposite walls of said contact chamber into the vicinity of an adjacent end of the bobbin.

7. An electromagnetic relay according to claim 6, wherein said casing members and said sealing means enclose said relay in such a manner as to separate said contact chamber from a coil chamber surrounding said coil.

8. An electromagnetic relay according to claim 7, wherein said casing members are of trough-like shape and are provided with ridge-like projections at areas of their internal surfaces at which they contact flanges of said bobbin.

9. An electromagnetic relay according to claim 8, wherein said flanges are formed with groove-like recesses disposed opposite said ridge-like projections.

10. An electromagnetic relay according to claim 1, wherein said terminals of said coil and said terminals of said contacts are surrounded at points at which they extend from said bobbin by sleeve-like formations of the material of said bobbin, such formations being provided on oppositely facing sides thereof with plane abutting surfaces for the two casing members.

11. An electromagnetic relay according to claim 10, wherein said sleeve-like formations of said bobbin are provided with inclined surfaces extending towards said plane in which said coil and contact terminals extend from said bobbin, the two casing members being arranged in contact with said inclined surfaces.

12. An electromagnetic relay according to claim 10, wherein said casing members are provided, on opposite sides of pairs of contact and coil terminals surrounded by said sleeve-like formations, with wall sections and projections extending in the directions in which said terminals extend from said bobbin.

13. An electromagnetic relay according to claim 10, wherein said casing members are provided with ridge-like projections in those areas in which they are in contact with one another, with said bobbin and with said sleeve-like formations.

14. An electromagnetic relay according to claim 1, wherein said two casing members are welded together under the influence of ultrasonic energy.

15. An electromagnetic relay according to claim 1, wherein said casing members are identical to each other.

* * * * *